United States Patent [19]

Halberg

[11] Patent Number: 5,037,269

[45] Date of Patent: Aug. 6, 1991

[54] SELF-LOCKING NOZZLE BLOCKS FOR STEAM TURBINES

[75] Inventor: Walter Halberg, Casselberry, Fla.

[73] Assignee: Westinghouse Electric Corp., Pittsburgh, Pa.

[21] Appl. No.: 470,474

[22] Filed: Jan. 26, 1990

[51] Int. Cl.[5] ..... F01D 25/26

[52] U.S. Cl. ..... 415/134; 415/108; 415/126

[58] Field of Search ..... 415/108, 134, 139, 136, 415/138, 202, 12, 126; 239/397.5

[56] References Cited

U.S. PATENT DOCUMENTS

| | | | |
|---|---|---|---|
| 2,447,942 | 8/1948 | Imbert et al. . | |
| 3,021,110 | 2/1962 | Rankin et al. . | |
| 3,748,059 | 7/1973 | Miller et al. | 415/139 |
| 4,391,565 | 7/1983 | Speak | 415/189 |
| 4,489,468 | 12/1984 | Straslicka . | |
| 4,642,025 | 2/1987 | Heiniger et al. | 415/139 |
| 4,812,106 | 3/1989 | Purgavie | 415/139 |
| 4,840,537 | 6/1989 | Silvestri et al. | 415/202 |

FOREIGN PATENT DOCUMENTS 62-126210 8/1987 Japan .

*Primary Examiner*—Edward K. Look
*Assistant Examiner*—Michael S. Lee
*Attorney, Agent, or Firm*—K. Bach

[57] ABSTRACT

An axial flow steam turbine has a self-locking nozzle block wherein the nozzle block has radially inwardly and outwardly extending flanges that seat in grooves formed in spaced shrouds of the nozzle ring, with locking pins provided, in bores in a rear arcuate section of the nozzle ring, formed from the material that has a thermal coefficient of expansion greater than the thermal coefficient of expansion of the material from which the nozzle ring is formed. Preferably, the nozzle block is formed from a material having a thermal coefficient of expansion comparable to that of the pins. Steam passing through the turbine heats its assembly such that the locking pins force the flanges of the nozzle block into sealing contact with a first arcuate section of the nozzle ring so as to prevent vibration and loosening of the nozzle block in the nozzle ring.

10 Claims, 3 Drawing Sheets

SELF-LOCKING NOZZLE BLOCKS FOR STEAM TURBINES

BACKGROUND OF THE INVENTION

The present invention relates to a self-locking nozzle block for use in axial flow steam turbines.

Axial flow steam turbines contain a rotor that is situated in a casing, or a pair of spaced casings, an outer casing and an inner casing that contains the rotor. In the inner casing, nozzle chambers are provided which change the direction of inlet steam from a radial to an axial direction and then through nozzle blocks that direct the steam to the blades and vanes of the turbine.

In operation of axial flow steam turbines, incoming steam is charged through inlet nozzles to a nozzle ring that contains a plurality of nozzle blocks, the nozzle blocks containing vanes that direct the steam to the control stage or first stage of expansion of the steam. It is important that the nozzle blocks be securely situated in the nozzle ring and vibration of the blocks prevented. The use of threaded fasterners to secure the nozzle block in the nozzle ring can cause problems when such threaded fasteners loosen and/or fail under high vibration or high temperatures. Such threaded fasteners are subject to severe stresses and failure is intensified because their rate of expansion is different than those of the nozzle blocks and ring. Failed fasteners can cause problems, such as loose blocks and other foreign fragments. Vibrations could cause the loose nozzle blocks to damage the rotors while fragments of broken fasteners could damage any adjacent materials and migrate to cause damage elsewhere.

Other locking members, such as locking keys have been prepared to secure nozzle blocks or shrouds in place. In U.S. Pat. No. 3,021,110, for example, a key is affixed to a turbine shell having a thermal coefficient of expansion substantially different from that of the turbine shell, the key affixed to the shell by a locating screw. The key's greater expansion at high temperatures closes a clearance gap between the key and the shell cooperating surfaces to secure a turbine nozzle rim and hold it in place. In that system, the expanding key needs a threaded fastener to hold it in place. This threaded fastener is subject to similar stresses and breakage potential as threaded fasteners used to directly affix a nozzle block in a nozzle ring. Additional damage could occur if the key itself were loosened or broken. The expanding key in that system fits between the nozzle ring or chamber surface and the nozzle block surface and wedge them together when expanded, and is proposed for use on the outer shroud only, with conventional bolts used to affix the nozzle blocks to the inner shroud, which bolts are subject to the stresses and breakage potential described previously. Also, when using such an expanding key, it is required that the nozzle ring be shaped with a considerable overhang which could cause excessive vibration.

It is an object of the present invention to provide a method for locking a nozzle block in a nozzle ring at high temperatures in a manner that does not require the use of threaded fasteners, welding, or other mechanical locking devices.

BRIEF SUMMARY OF THE INVENTION

The present invention relates to an axial flow steam turbine that has a self-locking nozzle block. The steam turbine, having a rotor in a casing, has an inlet nozzle ring that has radially spaced inner and outer shrouds with confronting grooves in each of the shrouds into which radially inwardly and outwardly extending flanges in a plurality of nozzle blocks seat. The nozzle ring is formed of a material having a first thermal coefficient of expansion, while the nozzle blocks are formed of a material having a thermal coefficient of expansion greater than that of the nozzle ring.

A plurality of apertures are formed through a first arcuate section of the nozzle ring and bores formed into a rear arcuate section thereof, with pairs of said apertures and bores being coaxially positioned. Locking pins, which have a thermal coefficient of expansion greater than that of the nozzle ring and comparable to that of the blocks, are situated in the bores in the rear arcuate section of the nozzle ring and have a first end which contacts an end wall of the bore and a second end which is flush with the face of the rear arcuate section at ambient temperatures.

Under operation of the turbine, the elevated temperature caused by steam passing therethrough heats the assembly such that the locking pins expand and force the flanges of the nozzle blocks into sealing contact with the first arcuate section of the nozzle ring and prevent vibration or loosening of the nozzle blocks in the nozzle ring.

According to the present method, a nozzle ring is provided having confronting grooves in the inner and outer shrouds, that form front and rear arcuate sections on the nozzle ring. Apertures are formed through the first arcuate section of the nozzle ring and bores coaxial therewith are formed in the rear arcuate section of the nozzle ring, the bores terminating at an end wall in the second arcuate section. A locking pin having a thermal coefficient of expansion greater than the nozzle ring is inserted through the aperture and into the bore into contact with the end wall formed by the bore, with a portion of the pin extending outwardly from the forwardly facing face of the rear arcuate section and into the groove. The groove is then finally machined, along with the protruding portion of the pin, to provide a second end of the pin that is flush with the forwardly facing face of the second arcuate section. A nozzle block, having a thermal coefficient of expansion greater than that of the nozzle ring, is inserted into the nozzle ring with radially inwardly and outwardly extending flanges on the nozzle blocks seated in the grooves.

BRIEF DESCRIPTION OF THE DRAWINGS

The invention will become more readily apparent from the following description of a preferred embodiment thereof, shown by way of example only, in the accompanying drawings, wherein.

DETAILED DESCRIPTION

Figure 1:
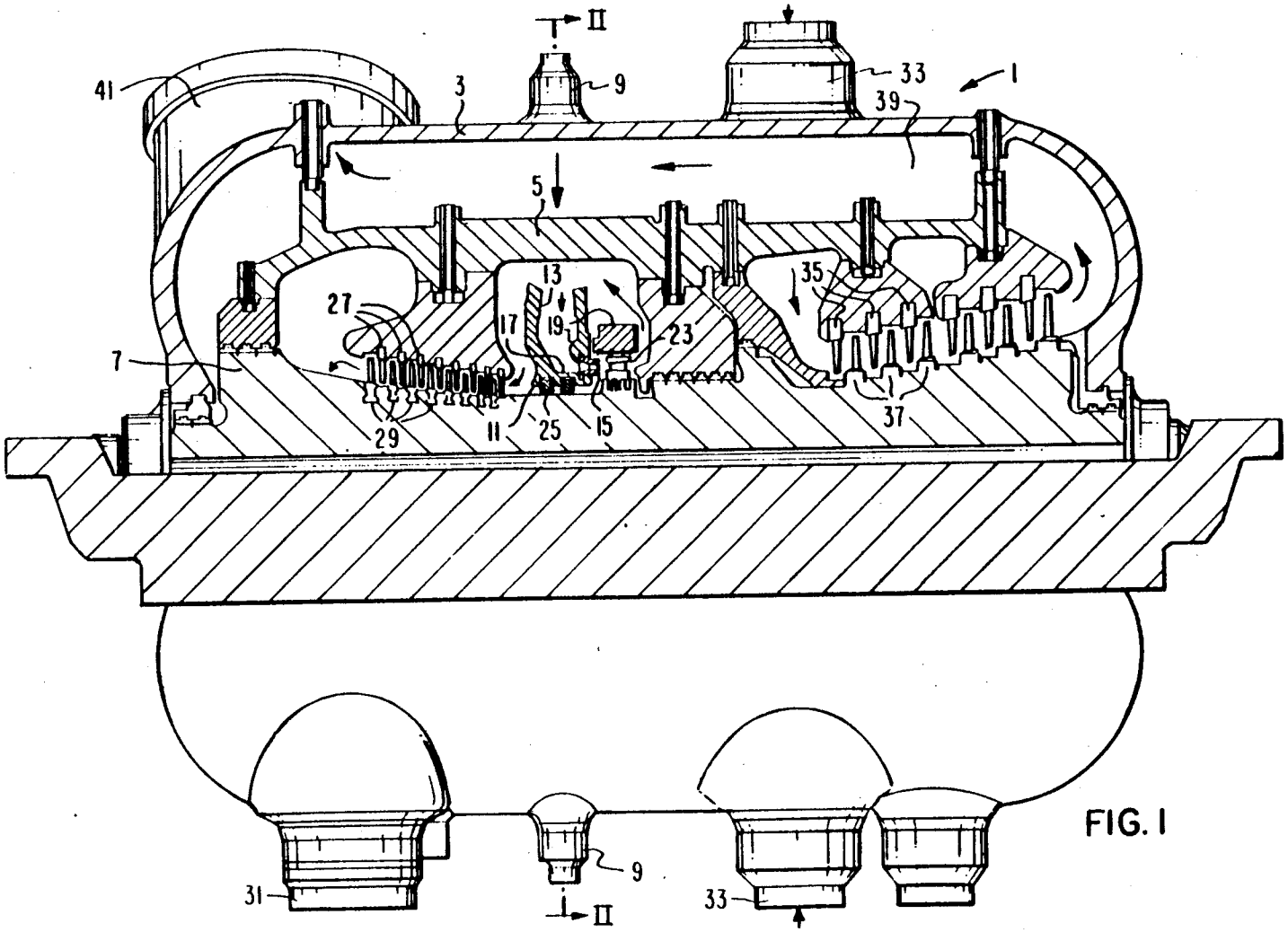
FIG. 1 is a partial sectional view of an axial flow steam turbine constructed in accordance with the present invention.
Figure 2:
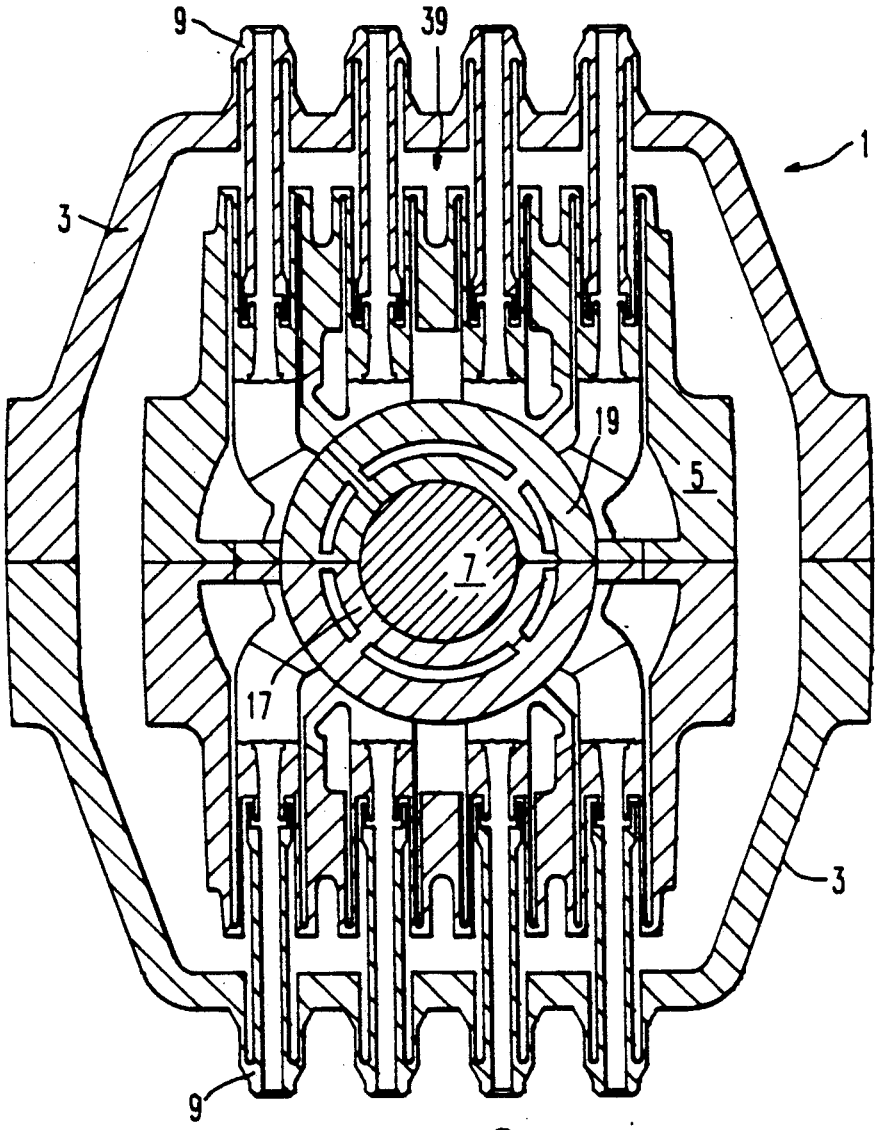
FIG. 2 is a cross-sectional view taken along lines II—II of FIG. 1.
Figure 3:
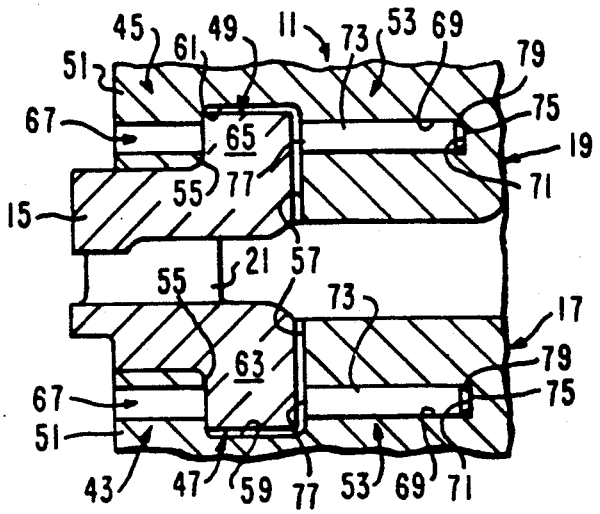
FIG. 3 is an enlarged cross-sectional view, looking from the opposite side of the turbine in FIG. 1, showing the area of the nozzle ring and nozzle blocks at ambient conditions.

Referring now to the drawings, FIG. 1 illustrates a partial sectional view of an axial flow steam turbine 1, having an outer casing or cylinder 3, and an inner casing or cylinder 5, which contain a rotor 7. In some embodiments of turbines, only the outer cylinder or casing 3 is provided and the present invention is also usable therein. The following description, however, will refer to an embodiment wherein an inner casing 5 is provided between the outer casing 3 and the rotor 7. A plurality of inlet nozzles 9 are provided which communicates with an inlet nozzle ring 11. The nozzle ring 11 is circumferentially disposed about the rotor 7 and includes a plurality of inlet nozzle chambers 13 that communicate with the inlet nozzles 9, and terminate, in an axial direction relative to rotor 7, as nozzle blocks 15, in radially spaced inner and outer sections 17, 19 of the nozzle ring. The nozzle chambers 13, generally about 4 or 6 or more of which are provided, manifold the steam charged through inlet nozzles 9 to nozzle blocks 15 through which the steam is initially expanded. Each of the nozzle blocks 15 includes a plurality of stationary vanes 21 (FIG. 3). The nozzle blocks 15 with vanes 21 control the expansion of the steam and impart the desired directional flow to the steam prior to its entry and subsequent expansion through control stage rotatable blades 23 which are connected to the rotor 7. Labyrinth seals 25 are provided between the nozzle ring 11 and rotor 7 to minimize leakage therebetween.

As an example of flow of steam through the turbine 1, the steam flows from inlet nozzle 9 to nozzle block 15, and through nozzle block 15 to control state rotatable blades 23. As indicated by the arrows (FIG. 1), the steam flow is then reversed and sent through a series of alternating stationary vanes 27 and rotatable turbine blades 29 so as to impart motion to the rotor 7. The steam then exits the casing through outlet conduit 31 to be reheated and, after reheating is returned through inlet conduits 33, with the reheated steam flowing through a further series of alternating stationary vanes 35 and rotatable blades 37, to induce further motion to the rotor 7. The steam is then passed through the spacing 39 between the outer casing 3 and inner casing 5, as a cooling medium, and is finally discharged from the turbine through an exhaust conduit 41.

Referring now to FIG. 3, the system of the present invention is illustrated in more detail. The inlet nozzle ring 11 is provided in two segments, section 17 forming an inner shroud 43 and section 19 forming an outer shroud 45. The inner shroud 43 has a groove 47 formed therein while the outer shroud 45 has a confronting groove 49 formed therein. The grooves 47, 49 provide a front arcuate section 51 on the nozzle ring 11 and a rear arcuate section 53, with a face 55 on the front arcuate section 51 and a face 57 on the rear arcuate section 53 which faces confront each other across the grooves 47 and 49. A base 59 is formed by groove 47 and a base 61 formed by groove 49 in the nozzle ring 11. The nozzle block 15, as illustrated, has a radially inwardly extending flange 63, adapted to seat in groove 47 of the inner shroud 43, and a radially outwardly extending flange 65, adapted to seat in groove 49 in the outer shroud 45.

A plurality of apertures 67 are formed through the front arcuate section 51 of the nozzle ring 11 which are coaxial with a plurality of bores 69 formed in the rear arcuate section 53 of the nozzle ring 11, the bores 69 forming an end wall 71. Locking pins 73 are positioned in the bores 69, the pins 73 having an inner or first end 75 that contacts the end wall 71 formed by the bore 69 and an outer second end 77 that is flush with the face 57 of the rear arcuate section 53 of the nozzle ring 11 (FIG. 3). Preferably, the inner or first end 75 has a beveled edge 79.

The nozzle block 15, in order to be inserted into the nozzle ring 11 will have flanges 63 and 65 slightly smaller in width w than the width of the grooves 47 and 49. The flanges also have a length that is slightly shorter than the depth of the grooves to permit radial expansion thereof. The present invention provides for the secure fixing of the flanges 63 and 65 in the grooves 47 and 49 by use of materials for various components that have different thermal coefficients of expansion. An inlet nozzle ring 11 is provided that has a first thermal coefficient of expansion. The nozzle block 15 and the locking pins 73 are formed from a material that has a second thermal coefficient of expansion that is significantly higher than the first thermal coefficient of expansion. By significantly higher, it is meant that the second thermal coefficient of expansion have a value at least about $1.5\times10^{-6}$ inch per inch per degree Fahrenheit (at 1000° F.) greater than the first thermal coefficient of expansion.

As examples of materials having the desired thermal coefficients of expansion, the nozzle ring could be formed from a 2.25% chromium-1% molybdenum ferrous alloy (SA-217 Grade WC9; ASTM specification) which has a thermal coefficient of expansion of $7.82\times10^{-6}$ in./in./°F. (at 1000° F.) or a 9% chromium-1% molybdenum ferrous alloy (SA-217 Grade C 12; ASTM specification) which has a thermal coefficient of expansion of $7.22\times10^{-6}$ in./in./°F. (at 1000° F.). The locking pins and nozzle blocks, by contrast, are formed from a material having a significantly greater thermal coefficient of expansion. The nozzle blocks may be made, for example, from 316 stainless steel which has a thermal coefficient of expansion of $10.16\times10^{-6}$ in./in./°F. (at 1000° F.), while the locking pins may be made, for example, from A286 stainless steel which has a thermal coefficient of expansion of $9.72\times10^{-6}$ in./in./°F. (at 1000° F.). The nozzle block and locking pin could be formed from the same material provided that the coefficient of expansion was as required, and preferably have comparable thermal coefficients of expansion, i.e., within about $0.6\times10^{-6}$ in./in./°F. (1000° F).

As an example of one embodiment of the present invention, a nozzle ring would be formed from a SA-217 Grade WC9 steel alloy with the grooves 47 and 49 having a depth of about 1.0 inch and width of about 1.5 inches forming first arcuate section having a width of about 1.30 inches. The nozzle block would be formed of 316 stainless steel alloy having flanges 63, 65 that fit within the grooves 47, 49 with a small clearance between the flanges and the walls of the grooves of about 0.003-0.005 inch at ambient temperature. The accuracy of the clearance is important to the successful operation of the present invention. The pins 73 would be formed from A286 stainless steel fitted in bores 69 having a diameter of about 0.50 inches and a length of about 2.5 inches.

Figure 4:
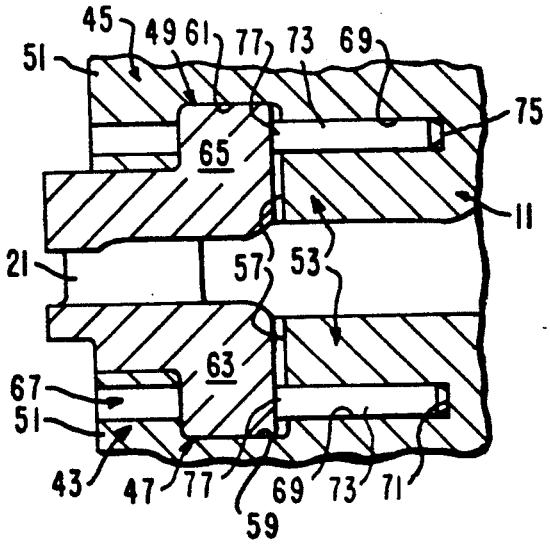
FIG. 4 is a view similar to FIG. 3 showing the nozzle ring and the nozzle blocks at elevated temperatures similar to operating temperatures of the turbine.

With the nozzle block 15 and locking pins 73 having a thermal coefficient of expansion greater than the nozzle ring 11, upon operation of the turbine and heating of the assembly by surrounding steam, the greater expansion of the nozzle block 15 and the pins 73 will close the small clearance that existed between the flanges 63 and 65 of the nozzle block 15 and the walls of the grooves 47 and 49 that existed under ambient conditions. By the time significant excitation is present, the expansion of pins 73 will be such that the second end 77 of the pin extends beyond the face 57 of the rear arcuate section 53 (FIG. 4) and contact the flanges 63 and 65 so as to force the flanges tightly against the face 55 on the first arcuate section 51 of the nozzle ring 11. Thus, there will be no clattering in a loose groove and vibration response of the nozzle blocks should be better controlled.

Figure 5:
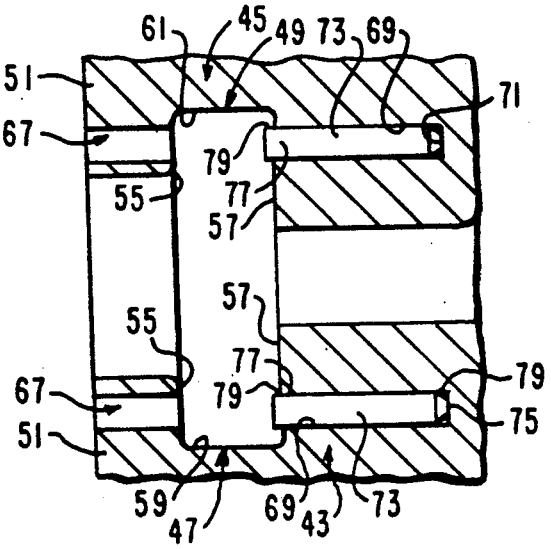
FIG. 5 is a view similar to FIG. 3 prior to machining of the groove wall locking pins and insertion of the nozzle block into the nozzle ring.

The present method of locking a nozzle block in a nozzle ring requires the providing of locking pins that have a coefficient of thermal expansion that is greater than the thermal coefficient of expansion of the nozzle ring. Referring now to FIG. 5, apertures 67 are formed through the front arcuate section of a nozzle ring 11, formed by the grooves 47 and 49, and bores 69, coaxial with the apertures 67 are formed in the rear arcuate section of the nozzle ring 11. Locking pins 73, of a material that has a coefficient of thermal expansion greater than that of the material of the nozzle ring 11 are inserted through the apertures 67 in front arcuate sections 51 and into the bores 69 in the rear arcuate sections 53. The locking pins are of a length sufficient that, when the first end 75 of the pin is in contact with the end wall 71 of the bore 69, a portion 79 of the second end 77 will extend beyond the face 57 of the rear arcuate section 53 into the grooves 47 and 49. The grooves 47 and 49 are then given a final machining to the desired width, with the exposed portion 79 of the pins machined smooth with the forwardly facing face 57 of the second arcuate section 53 of the nozzle ring 11. An adhesive or other securing means may be used to secure the pins 73 in bores 69 during the machining. The nozzle blocks 15 are then inserted into the nozzle ring 11 with their flanges 63, 65 seated in the grooves 47, 49 respectively, to provide an axial flow steam turbine having self locking nozzle blocks.

A series of the locking pins 73 would be provided about the nozzle ring 11, generally about 24–40 such pins per 180° arcuate section, with the pins spaced apart about the nozzle blocks at intervals of about 5° apart. The apertures 67 in the front arcuate section 51 of the nozzle ring 11 may be filled with a filler material or may remain open, if desired.

The present invention provides for secure capture of a locking means, the locking pins, by the nozzle blocks and prevents their loosening or breaking. With use of the present method, access to the bores in the rear arcuate section of the nozzle ring is provided by the aperture in the front arcuate section, with ready access existing to the ease of manufacturing is provided for sizing the length of the pins to the length of the bores, since the pins are later machined flush with the facing surface of the rear arcuate section.

What is claimed is:

1. An axial flow steam turbine comprising:

a rotor;

a casing;

an inlet nozzle ring disposed circumferentially about said rotor within said casing, having a first thermal coefficient of expansion, said inlet nozzle ring including radially spaced inner and outer shrouds, said shrouds having confronting grooves formed therein, forming front and rear arcuate sections having confronting faces, and a plurality of nozzle chambers communicating with said space;

a plurality of nozzle blocks, having a second thermal coefficient of expansion greater than the first coefficient of expansion of the inlet nozzle ring, and having radially inwardly and outwardly extending flanges, said flanges positioned in said confronting grooves between said front and rear arcuate sections of said inlet nozzle ring;

a plurality of apertures formed through the front arcuate section of said nozzle ring;

coaxial bores formed in the rear arcuate section thereof to form an end wall; and a locking pin, having a thermal coefficient of expansion greater than the first coefficient of expansion of the inlet nozzle ring, inserted into the bore in the rear arcuate section having a first end contacting said end wall, and a second end flush with said face of said rear arcuate section at ambient temperature.

2. An axial flow steam turbine as defined in claim 1, wherein said second coefficient of expansion is at $1.5\times10^{-6}$ in./in./°F. greater than said first coefficient of expansion.

3. An axial flow steam turbine as defined in claim 2, wherein said plurality of pins are spaced apart about said nozzle ring at intervals of about 5° apart.

4. An axial flow steam turbine as defined in claim 2, wherein said inlet nozzle ring comprises a steel alloy containing 2.25% by weight chromium and 1% molybdenum; said nozzle block comprises 316 stainless steel alloy, and said pins comprise A286 stainless steel alloy.

5. An axial flow steam turbine as defined in claim 2, wherein the thermal coefficient of expansion of the nozzle block is comparable to the thermal coefficient of expansion of the locking pin.

6. An axial flow steam turbine comprising:

a rotor;

a casing;

an inlet nozzle ring disposed circumferentially about said rotor within said casing, having a first thermal coefficient of expansion, said inlet nozzle ring including radially spaced inner and outer shrouds, said shrouds having confronting grooves formed therein, forming front and rear arcuate sections having confronting faces, and a plurality of nozzle chambers communicating with said space;

a plurality of nozzle blocks, having a second thermal coefficient of expansion at least $1.5\times10^{-6}$ in./in./°F. greater than the first coefficient of expansion of the inlet nozzle ring, and having radially inwardly and outwardly extending flanges, said flanges positioned in said confronting grooves between said front and rear arcuate sections of said inlet nozzle ring;

a plurality of apertures formed through the front arcuate section of said nozzle ring;

coaxial bores formed in the rear arcuate section thereof to form an end wall; and a locking pin, having a thermal coefficient of expansion comparable to the coefficient of expansion of the nozzle blocks, inserted into the bore in the rear arcuate section having a first end contacting said end wall, and a second end flush with said face of said rear arcuate section at ambient temperature.

7. An axial flow steam turbine as defined in claim 6, wherein said inlet nozzle ring comprises a steel alloy containing 2.25% by weight chromium and 1% molybdenum; said nozzle block comprises 316 stainless stell alloy, and said pins comprise A286 stainless steel alloy.

8. A method of locking a nozzle block in an inlet nozzle ring of an axial flow steam turbine, wherein said turbine has a rotor, a casing, and the inlet nozzle ring circumferentially disposed about the rotor within the casing, the inlet nozzle ring including radially spaced inner and outer shrouds having confronting grooves therein forming front and rear arcuate sections having confronting faces, one of which is a forwardly facing face of the rear arcuate section, and a plurality of nozzle chambers communicating with said space, comprising:

forming apertures through the front arcuate section of said nozzle ring;

forming coaxial bores into the rear arcuate section thereof to form an end wall;

providing a pin having a thermal coefficient of expansion greater than the thermal coefficient of expansion of said nozzle ring;

inserting a said pin through the aperture in the front arcuate section and into the bore in the rear arcuate section into contact with said end wall, with a portion of said pin extending outwardly from the forwardly facing face of the rear arcuate section into said grooves;

machining said forwardly facing face and said portion of said pin to form a finished surface with the pin-flush with the forwardly facing face; and inserting a nozzle block having radially inwardly and outwardly extending flanges into said nozzle ring with said flanges seated in said grooves.

9. The method of locking a nozzle block in an inlet nozzle ring of an axial flow steam turbine as defined in claim 8, wherein the thermal coefficient of expansion of said pin is at least $1.5 \times 10^{-6}$ in./in./°F. greater than the thermal coefficient of expansion of said nozzle ring.

10. The method of locking a nozzle block in an inlet nozzle ring of an axial flow steam turbine as defined in claim 9, wherein the thermal coefficient of expansion of said nozzle block is comparable to the thermal coefficient of expansion of said pin.

* * * * *